US012076602B1

(12) United States Patent
Brown

(10) Patent No.: US 12,076,602 B1
(45) Date of Patent: Sep. 3, 2024

(54) HAND-GRIPPED STRENGTH TRAINER

(71) Applicant: Joshua L. Brown, Jenks, OK (US)

(72) Inventor: Joshua L. Brown, Jenks, OK (US)

( * ) Notice: Subject to any disclaimer, the term of this patent is extended or adjusted under 35 U.S.C. 154(b) by 15 days.

(21) Appl. No.: 17/564,765

(22) Filed: Dec. 29, 2021

(51) Int. Cl.
*A63B 21/06* (2006.01)
*A63B 21/00* (2006.01)

(52) U.S. Cl.
CPC ..... *A63B 21/0604* (2013.01); *A63B 21/4035* (2015.10)

(58) Field of Classification Search
CPC ..... A63B 21/0004; A63B 21/0604; A63B 21/072; A63B 21/0724; A63B 21/0726; A63B 21/4023; A63B 21/4033; A63B 21/4035; A63B 21/4039; A63B 21/4043; A63B 23/12; A63B 23/1281; A63B 23/14; A63B 23/16
See application file for complete search history.

(56) References Cited

U.S. PATENT DOCUMENTS

D268,437 S * 3/1983 Giordano ..... A63B 21/072 D21/682
D340,759 S * 10/1993 Miller ..... A63B 23/1272 D21/680
9,789,348 B1 * 10/2017 Krull ..... A63B 21/072
11,235,191 B2 * 2/2022 Krull ..... A63B 23/1272
2003/0139257 A1 * 7/2003 Pemberton ..... A63B 23/16 482/44
2015/0126334 A1 * 5/2015 Newman ..... A63B 21/4039 482/24
2016/0144220 A1 * 5/2016 Wood ..... A63B 21/0601 482/93
2017/0209732 A1 * 7/2017 Polenz ..... A63B 21/4034
2017/0361147 A1 * 12/2017 Miller ..... A63B 21/0604
2019/0118025 A1 * 4/2019 Krull ..... A63B 21/072

* cited by examiner

*Primary Examiner* — Gary D Urbiel Goldner
(74) *Attorney, Agent, or Firm* — GableGotwals

(57) ABSTRACT

A hand-held training weight is useful in the development of hand-grip, wrist and arm strength. The hand-held training weight is ring-shaped and has radial cross-sections tapering from a smallest cross-sectional area to a greatest cross-sectional area and back to the smallest cross-sectional area in a closed-loop path. All of the cross-sectional areas are sized to be hand-gripped. The user can grip the weight with one hand at any location on the weight and extend the forearm to position the weight at a desired distance and direction from the user's body. The user can relocate the grip incrementally until the grip returns to the original grip location. At each incremental grip location the user can incrementally change the orientation of the forearm to create a personal training regimen.

10 Claims, 4 Drawing Sheets

HAND-GRIPPED STRENGTH TRAINER

BACKGROUND OF THE INVENTION

This invention relates generally to training weights and more particularly concerns a hand-held training weight useful in the development of hand-grip, wrist and arm strength.

Variable weight barbell systems have a hand-held bar and multiple pairs of discs attachable to the ends of the hand-held bar. Fixed weight barbell systems require multiple one-piece barbells of different weight. Whether variable or fixed weight, these systems require the dedication of significant storage and training floor space and are not amenable to transportation from one training location to another. They are designed to be gripped at the center of bar with their end weights balanced on the ends of the bar, so their center of gravity during use is at the center of the bar. Therefore, possible variations in moments and torque are minimal and not suited to hand-grip strength training. Similarly, dumbbells and kettlebells have separate components including a handle and two weights. They also afford limited hand-grip variations in a configuration that is not targeted at hand-grip strength training.

Wearable training systems include gloves and elastic wrist bands or sleeves with pockets containing fixed or insertable weights. They are readily transported but very limited in total weight. Since the weights are radially located on hand, wrist and arm surfaces, possible variations in moments and torque are also limited. Spring grip and ball type squeeze-and-release trainers afford only one level of resistance and are useful only for hand-grip exercises.

It is, therefore, an object of this invention to provide a unitary hand-gripped strength trainer which can be hand-gripped at any position along the trainer. Another object of this invention is to provide a hand-gripped strength trainer which facilitates the universal variation of hand-grip locations on the trainer. A further object of this invention is to provide a hand-gripped strength trainer which facilitates variations in grip intensity. Yet another object of this invention is to provide a hand-gripped strength trainer which facilitates variation of weight distribution in response to variations of hand placement. A further object of this invention is to provide a hand-gripped strength trainer which is entirely a handle and entirely a weight. Still another object of this invention is to provide a hand-gripped strength trainer which is useful for full-body strength training. An additional object of this invention is to provide a hand-gripped strength trainer which enables exercises not possible with known exercise equipment. And it is an object of this invention to provide a hand-gripped strength trainer which is interchangeable with other pieces of equipment for many exercises.

SUMMARY OF THE INVENTION

In accordance with the invention, a strength trainer is formed as a ring-shaped weight with radial cross-sections tapering from the smallest to the largest and from the largest to the smallest cross-sectional area of the weight. All of the cross-sectional areas are sized to be hand-gripped. The weight must define an opening sized to receive four fingers of a gripping hand in a fingers-together condition. The weight is preferably integrally formed from a homogeneous material and the largest and smallest cross-sectional areas are preferably on opposite sides of said opening.

The radial cross-sections may be circular or elliptical. The outer perimeter of the opening may be circular or elliptical. The outer perimeter of the weight may be circular or elliptical. The outer perimeters of the weight and the opening may be concentric or off-set.

In another embodiment, a ring-shaped weight has radial cross-sections tapering from the smallest to the largest and from the largest to the smallest cross-sectional area of the weight. All of the cross-sectional areas are sized to be hand-gripped. The weight defines an opening sized to receive four fingers of a gripping hand in a fingers-together condition. The surface of the weight is further defined by rotation of a first variable length radius about a Y axis to generate a linear representation of the weight while simultaneously rotating a second variable length radius about the linear representation of the weight.

BRIEF DESCRIPTION OF THE DRAWINGS

Other objects and advantages of the invention will become apparent upon reading the following detailed description and upon reference to the drawings in which.

While the invention is described in connection with various embodiments thereof, it will be understood that it is not intended to limit the invention to those embodiments or to the surface shapes illustrated in the accompanying drawings.

DETAILED DESCRIPTION

Figure 1:
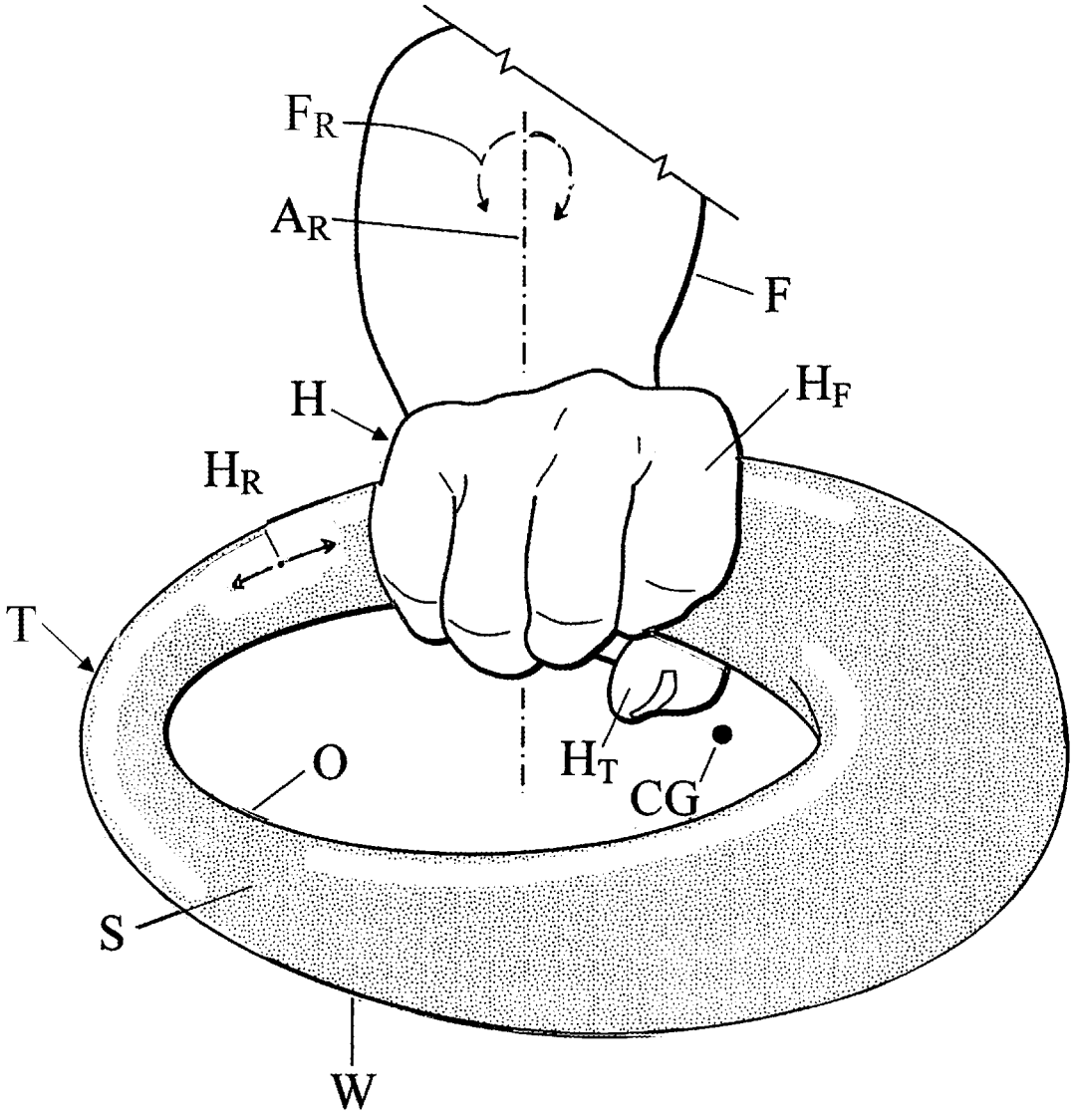
FIG. 1 is a perspective view of a training weight in accordance with the invention gripped by a user's hand.
Figure 2:
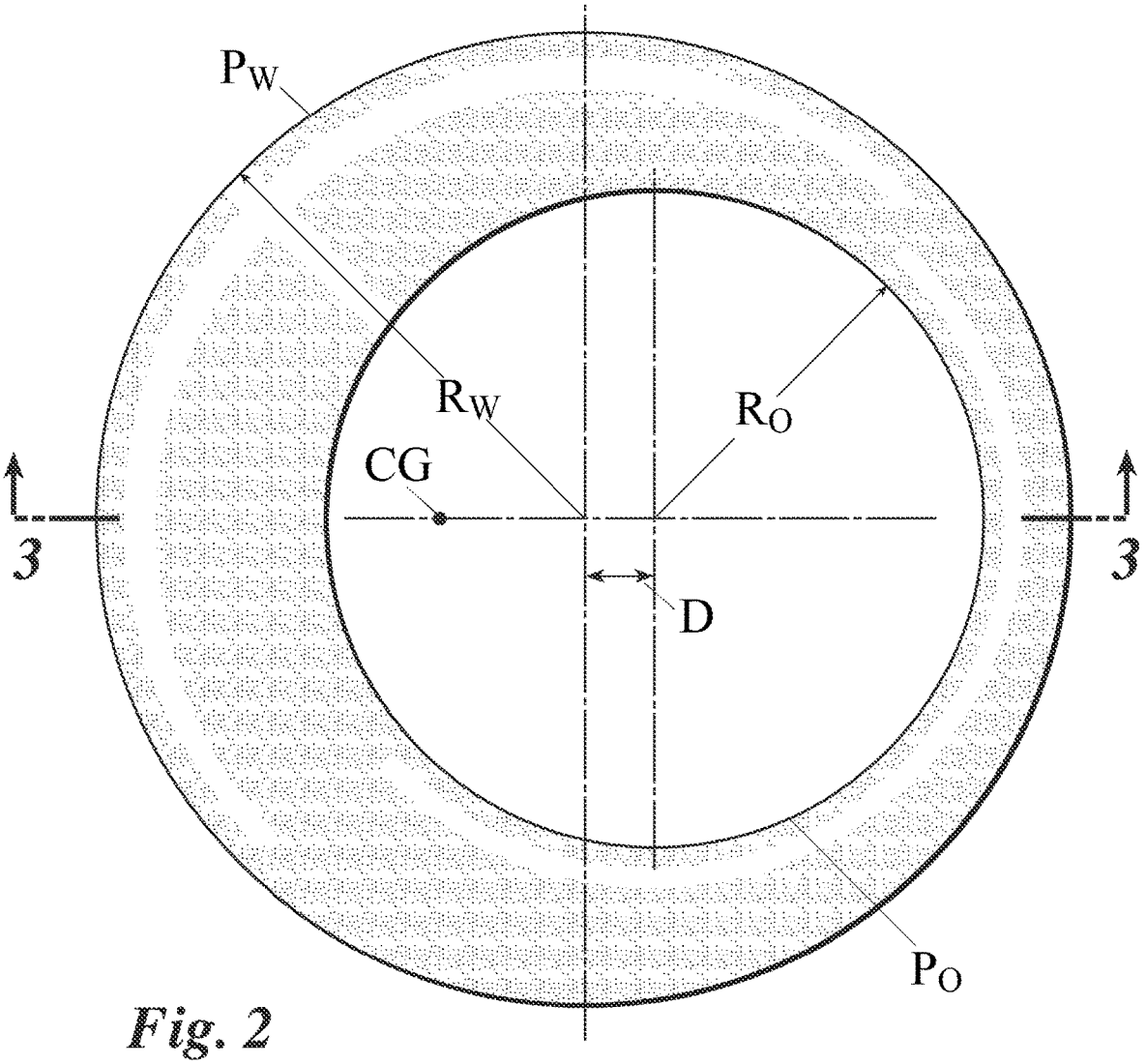
FIG. 2 is a top plan view of the training weight of FIG. 1.
Figure 3:
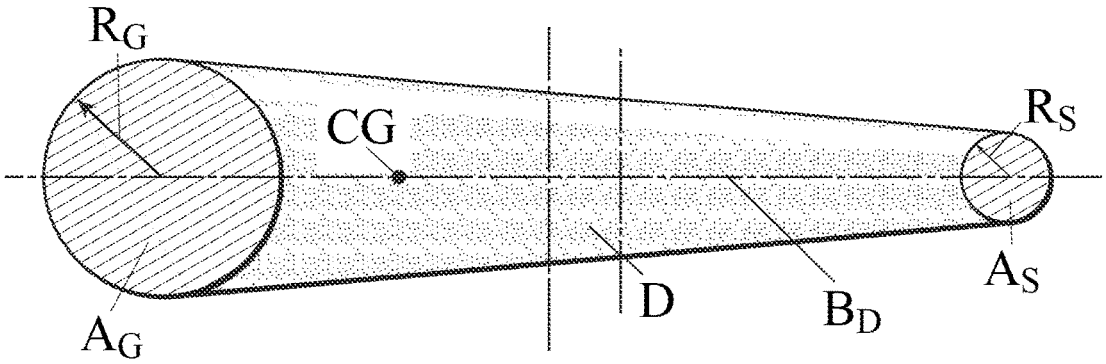
FIG. 3 is a cross-sectional view taken along the line 3-3 of FIG. 2.

Looking initially at FIGS. 1-3, a strength trainer T is formed as a ring-shaped weight W. Radial cross-sections of the weight W taper from the smallest cross-sectional area $A_S$ to the greatest cross-sectional area $A_G$ and from the greatest cross-sectional area $A_G$ back to the smallest cross-sectional area $A_S$ in a closed-loop path. All of the cross-sectional areas are sized to be hand-gripped.

The weight W can be gripped with one hand H at any location along the surface S. The weight W defines an opening O sized to receive four fingers $H_F$ of a gripping hand in a fingers-together condition. Preferably, and as best seen in FIG. 1, the opening O is sized and shaped so that, with the fingers $H_F$ in a fingers-together condition, the fingers $H_F$ and the thumb $H_T$ can be opposed on the weight W and wrapped toward each other in the opening O.

In the grip shown in FIG. 1, the forearm F of the user is extended generally radially toward the weight W and the user's hand H grips the weight W between the smallest and greatest cross-sectional areas $A_S$ and $A_G$. As shown, the user's thumb $H_T$ overlaps the user's forefinger $H_F$. If the grip of the user's hand H is incrementally relocated toward the smallest cross-sectional area $A_S$, the overlap, if any, will increase. If the grip of the user's hand H is incrementally relocated toward the greatest cross-sectional area $A_G$, the overlap will decrease and might eventually become an increasing separation of the thumb and forefinger. Such a separation is acceptable as long as the user is able to maintain one-handed control of the weight W. Preferably, the smallest and greatest cross-sectional areas $A_S$ and $A_G$ are aligned on a diametric plane $B_D$ and the weight W is symmetrical on the diametric plane $B_D$.

Continuing to look at FIG. 1, the center of gravity CG of the tapered weight W shown is located within the opening O and proximate the greatest cross-sectional area $A_G$ of the weight W. If the user's hand H is incrementally relocated in either direction HR on the weight W, the moments applied by the weight W will be different for each incremental relocation because the distance to the center of gravity CG along the rotational axis $A_R$ of the forearm F is different at each incremental relocation. If the user incrementally changes the angular orientation of the forearm F in either direction $F_R$ about the rotational axis $A_R$ of the forearm F, the torque applied by the weight W to the forearm F will be different at each incremental orientation because the CG of the weight W rotates in unison with the forearm F.

Taking advantage of the above described variations in moment and torque, in one exemplary use of the trainer T in a training exercise, the user can grip the weight W with either hand H at any location on the weight W and extend the forearm F to position the weight W at a desired distance and direction from the user's body. The user can relocate the grip incrementally until the grip returns to the original grip location. At each incremental grip location the moment has changed. At each moment change increment, the user can incrementally change the orientation of the forearm F. A full range of torque increments is thus applied to a full range of moment increments.

The possibilities for variations in the configuration of the trainer T in order to focus on particular moment or torque related needs are many. For example, FIGS. 1-3 illustrate an offset circle embodiment of the tapered trainer T. As best seen in FIG. 2, the outer perimeter $P_W$ of the weight W is a circle of radius $R_W$. The outer perimeter $P_O$ of the opening O is a smaller circle of radius $R_O$. The centers of the circles are off-set by a distance D. Greater off-sets D will accentuate the taper of the surface S. As best seen in FIG. 3, all of the radial cross-sectional areas of the weight W are circles. The smallest and greatest cross-sectional areas $A_S$ and $A_G$ have radii $R_S$ and $R_G$, respectively.

Figure 4:
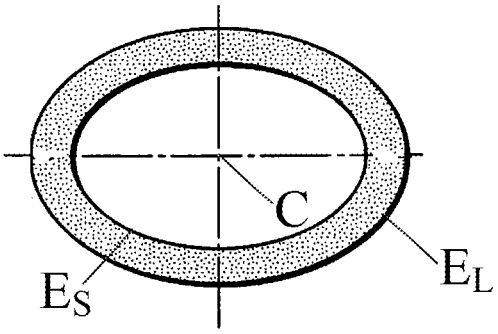
FIG. 4 is a top plan view of a concentric ellipse-within-an-ellipse embodiment of the invention.
Figure 5:
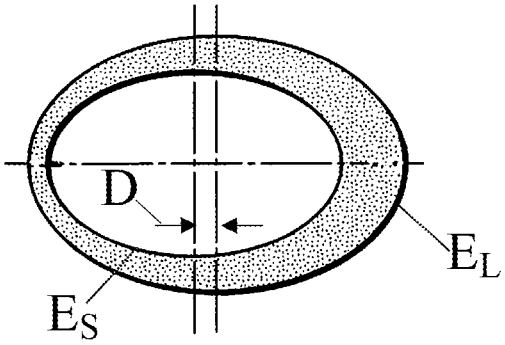
FIG. 5 is a top plan view of an off-set ellipse-within-an-ellipse embodiment of the invention.
Figure 6:
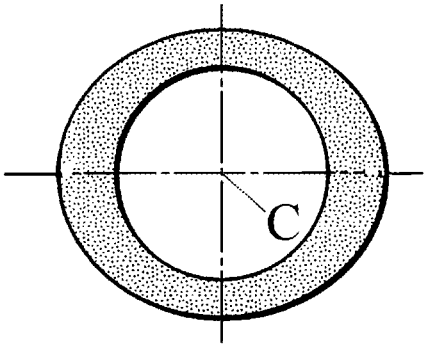
FIG. 6 is a top plan view of a concentric circle-within-an-ellipse embodiment of the invention.
Figure 7:
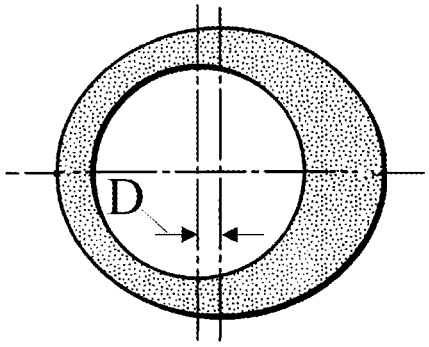
FIG. 7 is a top plan view of an off-set circle-within-an-ellipse embodiment of the invention.
Figure 8:
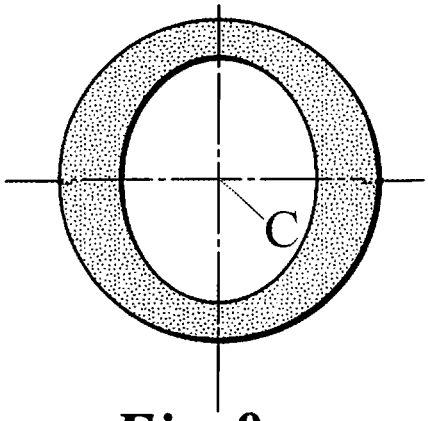
FIG. 8 is a top plan view of a concentric ellipse-within-a-circle embodiment of the invention.
Figure 9:
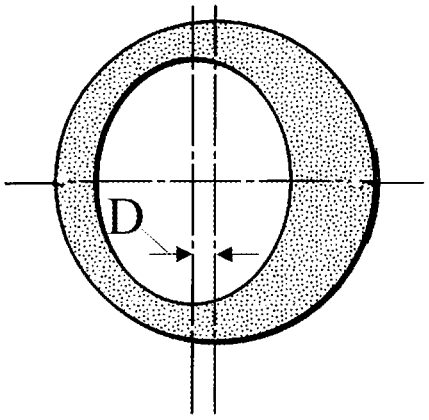
FIG. 9 is a top plan view of an off-set ellipse-within-a-circle-embodiment of the invention.

There are many other possible configurations including, but not limited to, concentric C and off-set D ellipses with one ellipse $E_S$ within another ellipse $E_L$ as seen in FIG. 4 and FIG. 5, respectively; concentric C and off-set D circle and ellipse with the circle inside of the ellipse as seen in FIG. 6 and FIG. 7, respectively; and concentric C and off-set D ellipse with the ellipse inside of the circle as seen in FIG. 8 and FIG. 9, respectively. And in any of these configurations, the radial cross-sections of the weight W may, for example, be circular or elliptical.

Figure 10:
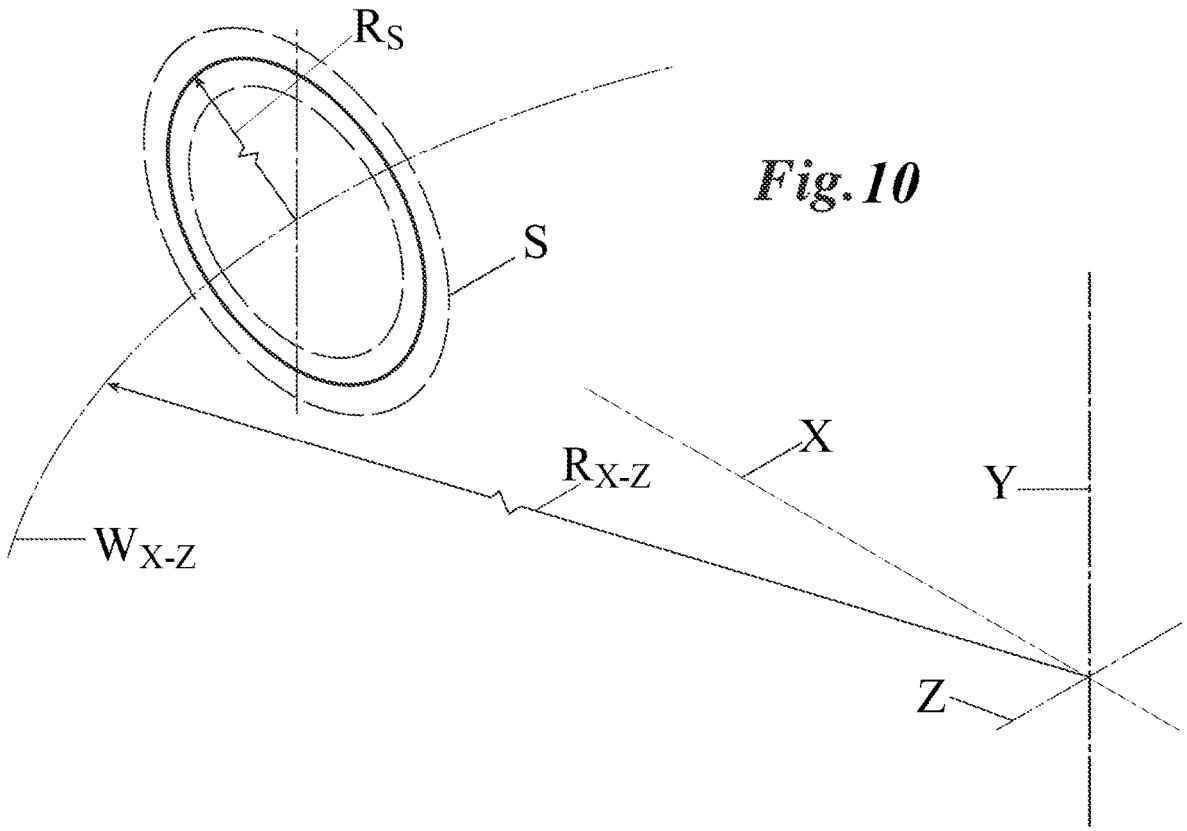
FIG. 10 is an isometric representation illustrating parameters useful in understanding the configuration of the surface of the weight in accordance with the invention.

Turning to FIG. 10, the extent of the variations can be more fully understood by considering that the surface S can be generated by rotating a first variable length radius $R_{X\text{-}Z}$ about a Y axis to generate a linear representation $W_{X\text{-}Z}$ of the weight W in the X-Z plane while simultaneously rotating a second variable length radius $R_S$ about the linear representation $W_{X\text{-}Z}$ of the weight W to generate the surface S of the weight W. Still, in any embodiment of the trainer, radial cross-sections of the weight W must taper from the smallest cross-sectional area to the greatest cross-sectional area of the weight and from the greatest cross-sectional area back to the smallest cross-sectional area and all radial cross-sections of the weight W must be sized to be hand-gripped.

In a functional prototype of a circular embodiment of the trainer, the smallest radial cross-section of the weight is one inch in diameter, the greatest radial cross-section of the weight is three inches in diameter and the opening through the weight is eight inches in diameter, so the outer perimeter of the trainer has a 12 inch diameter. The prototype weighs 9 pounds.

The largest and smallest cross-sectional areas need not necessarily be on opposite sides of the opening. The slope of the taper may be variable. A comparatively limited regimen of exercise can be achieved by training with a crescent-shaped segment of the closed-loop trainer as herein described. Preferably, the configuration of the weight W will permit smooth passage of the palm side of a user's hand H sliding along the surface S from one location on the weight W to another. Preferably, the weight W will be integrally formed of a solid homogeneous material, but the weight W may be hollow, may include one or more layers of different homogeneous materials and may include an exterior protective coating.

Thus, it is apparent that there has been provided, in accordance with the invention, a hand-gripped strength trainer that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A strength trainer comprising a ring-shaped weight having radial cross-sections tapering from a smallest cross-sectional area to a largest cross-sectional area and from said largest cross-sectional area to said smallest cross-sectional area of said ring-shaped weight, all said cross-sectional areas being sized to be hand-gripped, said ring-shaped weight having a center of gravity proximate said largest cross-sectional area.

2. The strength trainer according to claim 1, said ring-shaped weight defining an opening sized to receive four fingers of a gripping hand in a fingers-together condition.

3. The strength trainer according to claim 1, said ring-shaped weight being integrally formed from a homogeneous material.

4. The strength trainer according to claim 2, said largest and smallest cross-sectional areas being on opposite sides of said opening.

5. The strength trainer according to claim 1, said radial cross-sections being one of circular and elliptical.

6. The strength trainer according to claim 2, an outer perimeter of said opening being one of circular and elliptical.

7. The strength trainer according to claim 6, an outer perimeter of said ring-shaped weight being one of circular and elliptical.

8. The strength trainer according to claim 7, said outer perimeters being concentric.

9. The strength trainer according to claim 7, said outer perimeters being off-set.

10. The strength trainer according to claim 1, wherein a surface of said ring-shaped weight being defined by rotation of a first variable length radius about a Y axis to generate a linear representation of the ring-shaped weight while simultaneously rotating a second variable length radius about said linear representation of said ring-shaped weight.

* * * * *